United States Patent [19]

Bradam

[11] 4,194,097

[45] Mar. 18, 1980

[54] MEMBRANE KEYBOARD APPARATUS WITH TACTILE FEEDBACK

[75] Inventor: William R. Bradam, Cambridge, Ohio

[73] Assignee: NCR Corporation, Dayton, Ohio

[21] Appl. No.: 915,036

[22] Filed: Jun. 12, 1978

[51] Int. Cl.[2] ..... H01H 13/70

[52] U.S. Cl. ..... 200/5 A; 200/159 B

[58] Field of Search ..... 200/5 R, 5 A, 86 R, 200/159 R, 292, 302

[56] References Cited

U.S. PATENT DOCUMENTS

| | | | |
|---|---|---|---|
| 3,120,584 | 2/1964 | Grunfelder et al. | 200/5 E |
| 3,383,487 | 5/1968 | Wiener | 200/302 |
| 3,617,666 | 11/1971 | Brave | 200/86 R |
| 3,860,771 | 1/1975 | Lynn et al. | 200/5 A |
| 3,988,551 | 10/1976 | Larson | 200/5 A |
| 4,046,975 | 9/1977 | Seeger, Jr. | 200/302 X |

OTHER PUBLICATIONS

Johnson, D. O., Jr.; IBM Tech. Disc. Bull., "Keyboard and Wiping Contact Assembly;" Dec. 1970; vol. 13, No. 7; pp. 1962, 1963.

*Primary Examiner*—James R. Scott
*Attorney, Agent, or Firm*—J. T. Cavender; Wilbert Hawk, Jr.; Richard W. Lavin

[57] ABSTRACT

There is disclosed a membrane-type keyboard comprising a support member, a pair of spaced-apart sheets of flexible insulating material having designated key portions positioned adjacent to and spaced from said support member and a pair of electrical conductors each attached to adjacent inner surfaces of said key portions. The depression of a key portion of the top sheet forces the adjacent electrical conductors into contact. Further depression of the key portion of the top sheet moves both electrical conductors and the key portions of the spaced-apart sheets a distance sufficient to provide a positive degree of tactile feedback to the operator.

11 Claims, 4 Drawing Figures

MEMBRANE KEYBOARD APPARATUS WITH TACTILE FEEDBACK

BACKGROUND OF THE INVENTION

The present invention is directed to a printed circuit keyboard, and more particularly, to a low-cost keyboard for use in a data terminal device. Data terminal devices are presently used in supermarket or fast food establishments which require fast checkout operations. With the introduction of low-cost printed circuit keyboards for use with data terminal devices employed in the above-cited operating conditions, problems have arisen in using such keyboards in that most keyboards have relatively flat contact surface portions which comprise key positions. Depression of a key position of this type keyboard provides very little tactile feedback to the operator. The use of this keyboard requires the operater to observe the required key position on the keyboard before depressing such key position. Because of this construction, the overall speed of operation of the keyboard is reduced as compared to a mechanical type keyboard wherein the operator, by the feel of each key, knows the location of the key required to be depressed without looking at the keyboard. In order to overcome this drawback, printed circuit keyboards have been constructed with raised portions or spherical proturbances corresponding to each key location on the keyboard. Examples of this type of construction may be found in U.S. Pat. Nos. 3,898,421, 3,988,551, 4,059,737 and 4,060,703. While this type of construction increases the tactile feedback of the raised portions, none produce fully the tactile feedback of a mechanical key operation. Other types of keyboards developed to solve the problem of tactile feedback include U.S. Pat. No. 3,898,421 which provides a keyboard construction in which a dimple portion is forced into engagement with a pair of fixed contacts to provide a switch closing operation intermediate the stroke of the dimple portion, the construction allowing the central portion of the dimple to move between the fixed contacts into engagement with a support member to eliminate excessive wear of the contact area. While this construction reduces the wear of the contact area of the dimple portion, it does not produce any greater tactile feedback other than the use of the raised dimple construction. It is therefore a principal object of this invention to provide a printed circuit keyboard construction which produces a tactile feedback to the operator similar to that of a mechanical key switch operation. It is a further object of this invention to provide such a keyboard which is simple in construction and low in cost.

SUMMARY OF THE INVENTION

In order to fulfill these objects, there is provided in one embodiment a printed circuit keyboard comprising a flexible cover sheet of insulating material having a plurality of raised proturbances or bubble portions each having a first electrical conductor secured to its lower surface, a flexible support sheet spaced from said cover sheet and having correspondingly aligned bubble portions, a second electrical conductor secured to the upper surface of the support sheet and spaced from the first electrical conductor, a spacer sheet and a support member each having a recessed area aligned with the bubble portions in said cover and support sheets. The depression of a bubble portion in the cover sheet results in the initial contact between adjacent first and second electrical conductors followed by the further movement of both the bubble portions in the cover and the support sheet together with said first and second electrical conductors a predetermined distance to provide a positive tactile feedback to the operator.

BRIEF DESCRIPTION OF THE DRAWING

Additional advantages and features of the present invention will become apparent and fully understood from a reading of the following description taken together with the annexed drawing, in which.

DESCRIPTION OF THE PREFERRED EMBODIMENT

Figure 1:
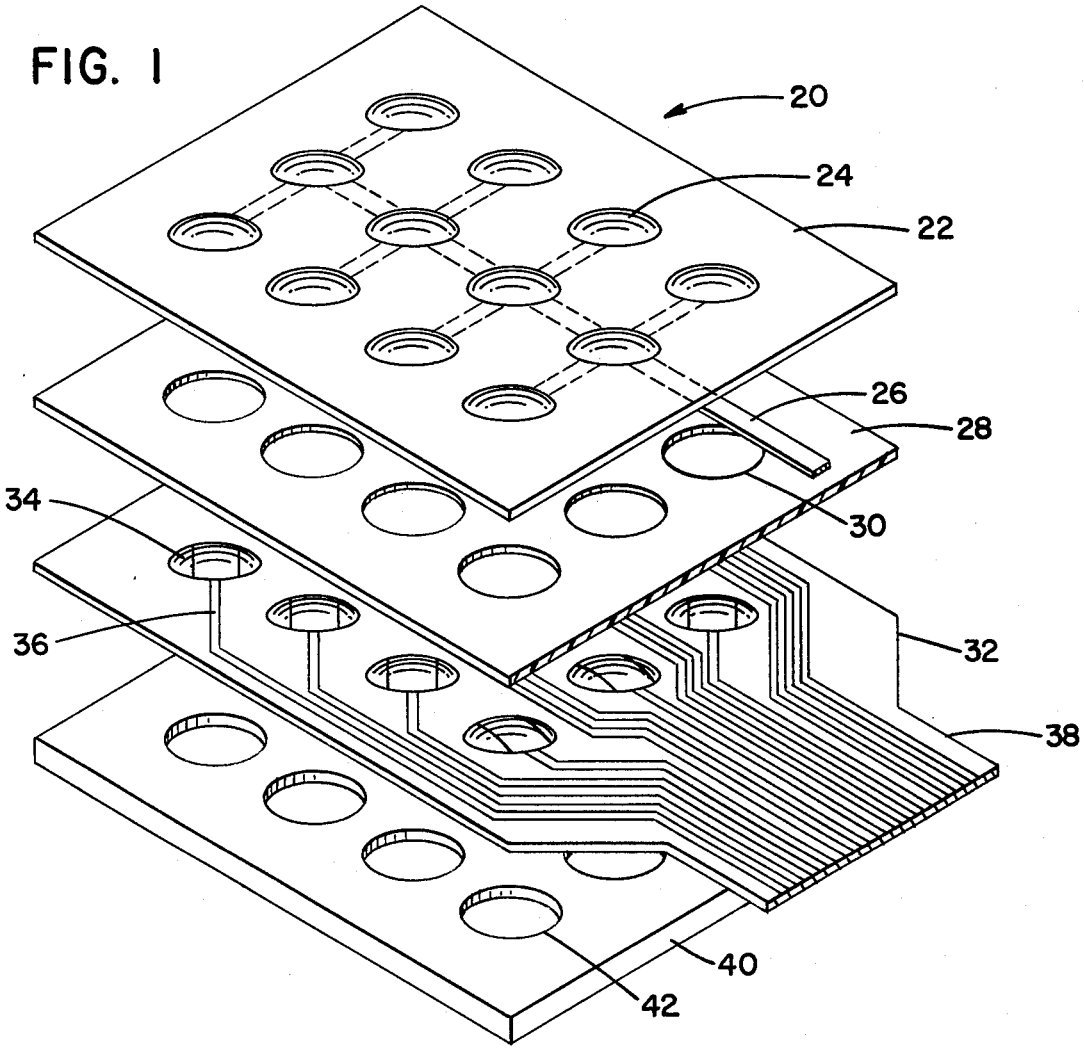
FIG. 1 is an exploded view of one embodiment of the keyboard construction in accordance with the present invention.

Referring now to FIG. 1, there is shown an exploded view of one embodiment of a printed circuit keyboard indicated by the numeral 20 and constructed in accordance with the present invention. The keyboard 20 includes a cover sheet 22 of insulating material composed preferably of a flexible plastic sheet material such as Mylar having a plurality of spherical proturbances or bubble portions 24 formed in a predetermined arrangement in said cover sheet 22 in any well-known manner such as molding. Other examples of flexible plastic sheet material that may be used in the present embodiment includes polypropylene, polycarbonate, fluorplastics, ABS and polyvinyl chlorides. The cover sheet 22 being composed preferably of a sufficiently resilient material provides that after depression, the bubble portions 24 will spring back to their raised position shown more clearly in FIG. 2. Each bubble portion 24 may have printed or affixed to its upper surface in a manner that is well-known in the art, an indicia representing the key designation as is conventional in the art.

Secured to the lower surface of each of the bubble portions 24 is a flexible electrical conductor 26 which may take the form of a coating composed of electrically conductive particles such as silver in a resilient plastic binder such as Versalon 1140 by General Electric. As shown in FIG. 1, the conductor 26 is common to each of the bubble portions 24 and extends from the sheet 22 to an appropriate electrical source located within the data terminal (not shown). It is obvious that other electrical conductors 26 such as flexible strips of conducting material may also be used in place of the coating 26.

Positioned adjacent the sheet 22 is a spacer sheet 28 preferably composed of an insulator material such as Mylar having a plurality of apertures 30, each in registration with one of the bubble portions 24. As shown more clearly in FIG. 2, the apertures 30 have a diameter preferably equal to or larger than the diameter of the bubble portions 24.

Located adjacent and below the spacer sheet 28 is a flexible support sheet 32 having a plurality of bubble portions 34 each located in registration with one of said apertures 30 in sheet 28 and an associated bubble portion 24 in sheet 22. The support sheet 32 is preferably composed of the same flexible insulating material as that of sheet 22 and has secured to the top surface of each of the bubble portions 24 an individual electrical conductor 36 which, as shown in FIG. 1, extends through a neck portion 38 of the sheet 32 for connection to the terminal in which the keyboard 20 is located in a manner that is well-known in the art. The conductor 36 may be composed of the same material as that of electrical conductor coating 26. The bubble portions 24 and 34 are preferably formed with the same radius of curvature in order for the electrical conductors 26 and 36 to be in a spaced-apart position (FIG. 2) prior to depression of the bubble portion 24 by the operator. The conductor 36 may cover only a portion of the upper surface of the bubble portion 34 or may be fabricated to conform to the total upper surface of the bubble portion 34 to insure a more complete contact with the conductor strip 26.

The sheets 22, 28 and 32 are mounted on a printed circuit board 40 (FIGS. 1 and 2) or any other type of supporting member in any conventional manner such as bonding, which circuit board 40 includes a plurality of recessed portions 42 in registration with the bubble portions 24 and 34 and the apertures 30.

In operation, the finger portion 44 (FIGS. 2 and 4) of an operator engages and depresses a selected bubble portion 24 in the sheet 22 until the electrical conductor 26 makes contact with the electrical conductor 36 secured to sheet 32, thereby generating an electrical signal over conductor 36 identifying the bubble portion 24 depressed in a manner that is well-known in the art. Further movement of the bubble portion 24 results in the electrical conductors 26 and 36, together with the bubble portion 34 moving downward into the recessed portion 42 of the printed circuit board 40 to provide an overthrow movement, which overthrow movement increases the tactile feedback to the operator when depressing the bubble portions 24. Since this construction produces a tactile feedback similar to that of a mechanical key switch operation, the operator can learn the locations of each of the bubble portions 24 by the feel of the location of the bubble portions therefore allowing her to operate the keyboard without looking at the specific bubble portion required to be depressed.

Figure 2:
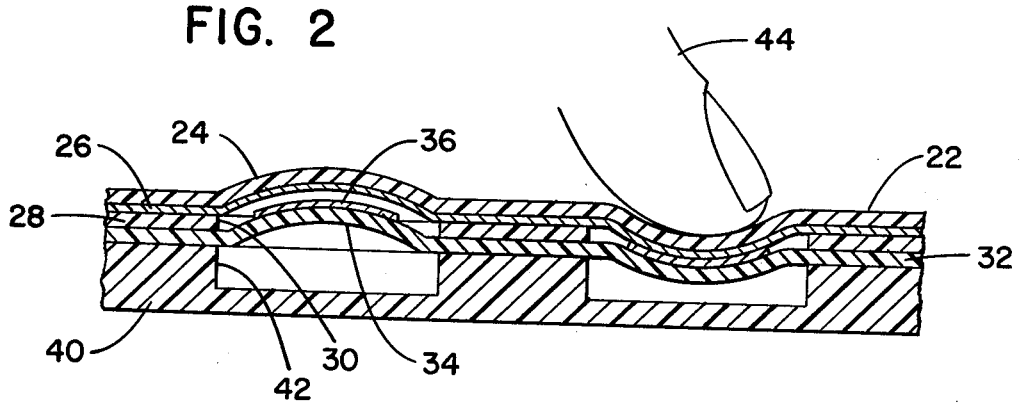
FIG. 2 is a cross-section view illustrating the keyboard construction of the embodiment shown in FIG. 1.
Figure 3:
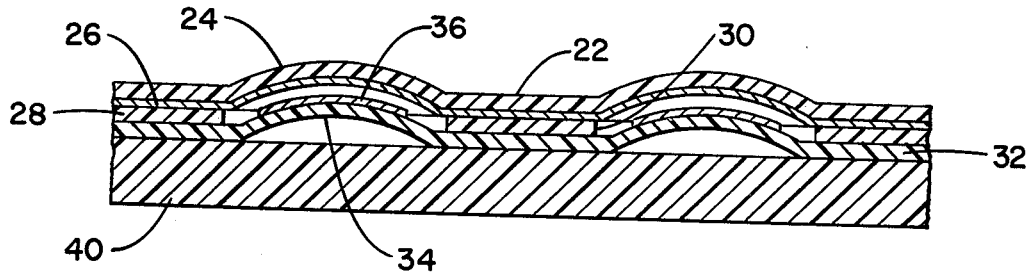
FIG. 3 is a cross-section view illustrating the keyboard construction of a second embodiment of the present invention.

A second embodiment of the invention is shown in FIG. 3 in which parts similar to or corresponding to parts shown in FIGS. 1 and 2 are numbered similarly. With reference to FIG. 3, the keyboard 20 includes the printed circuit board 40, fabricated without the recessed portions 42 as shown in FIG. 2. It will be obvious that this construction limits the overthrow movement of the bubble portions 24 and 34. This construction may be used in those situations where the resilient characteristics of the sheets 22 and 32 (FIG. 1) are much stiffer than the corresponding sheets of the embodiment shown in FIGS. 1 and 2, thereby requiring less movement of the bubble portions 24 and 34 to provide the required tactile feedback.

Figure 4:
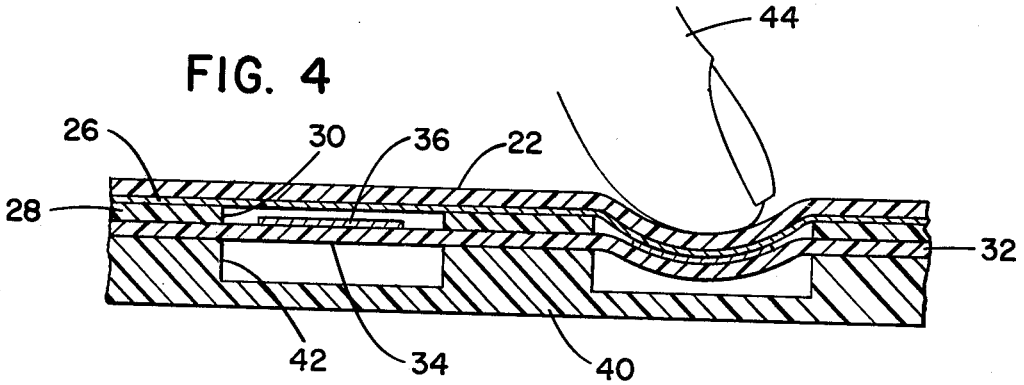
FIG. 4 is a cross-section illustrating the keyboard construction of a third embodiment of the present invention.

A third embodiment of the invention is shown in FIG. 4 in which parts similar to or corresponding to parts shown in FIGS. 1 and 2 are numbered similarly. The keyboard 20 disclosed in FIG. 4 provides the sheets 22 and 32 without the bubble portions 24 and 34 shown in FIG. 2. Otherwise, the construction is the same. It is obvious from FIG. 4 that the keyboard construction shown therein will provide the overthrow movement and therefore the tactile feedback in those applications where the keyboard does not require a bubble-type construction, that is, where the application requires a flat keyboard having a large number of key position, such as 150 key positions. In this situation, the operator is required to look at the keyboard for the specific key designation before depressing the selected key position. The present invention will provide a tactile feedback to the operator indicating that the key contacts have been closed, thereby eliminating keyboard mis-operations due to the failure of the operator to depress the key position in the cover sheet 22 a sufficient distance to close the electrical conductors 26 and 36 (FIG. 4).

While the principles of the invention have now been made clear in an illustrated embodiment, it will be obvious that those skilled in the art that many modifications of structure, arrangements, elements and components can be made which are particularly adapted for specific environments without departing from those principles. The appended claims are therefore intended to cover and embrace any such modifications within the limits only of the true spirit and scope of the invention.

What is claimed is:

1. A keyboard apparatus comprising:

support means having a plurality of recessed portions each defining a key portion;

a first flexible support member mounted on said support means having first designated key portions, each in registration with one of said recessed portions;

a second flexible support member mounted on said support means and spaced from said first flexible support member, said second support member having second designated key portions each in registration with an associated one of said first key portion and spaced therefrom;

a first electrical conducting means secured to the inner surface of said first key portion;

and a second electrical conducting means secured to a surface of said second key portions adjacent said first conducting means and spaced therefrom whereby upon depression of a selected one of said first designated key portions, said first and second support members together with their associated electrical conducting means move toward said support member to provide an electrical contact between adjacent electrical conducting means and are further moved into the recessed portion of said support means a distance to provide a tactile feedback with respect to the operation of the key portions.

2. The keyboard apparatus of claim 1 in which said first and second designated key portions comprise bubble-shaped proturbances, the proturbances of the second flexible support member having a contact portion spaced from said support means a distance sufficient for the depressed proturbances of said first and second flexible support member to move after contact is made between said first and second electrical conducting means and for further movement into said recessed portion a distance sufficient to provide a tactile feedback with respect to the depression of the proturbances.

3. The keyboard apparatus of claim 2 in which said first and second flexible support members comprise a pair of planar sheets of flexible plastic material separated by a sheet of insulating material having apertures therein each in registration with the recessed portions of said support means and the key portions of said sheets of flexible plastic material to allow said key portions and said first and second electrical conducting means to extend into the recessed area when depressed a distance to increase the tactile feedback with respect to such depression.

4. A manually-actuable keyboard apparatus comprising:

a non-conductive substrate having a plurality of recessed portions formed therein whose width defines a key portion;

a first sheet of flexible material positioned on said substrate having a plurality of first key portions formed integral with said flexible material each in registration with one of said recessed portions;

a second sheet of flexible material spaced a predetermined distance from said first sheet and having a plurality of second key portions formed integral with said flexible material, each key portion spaced from said substrate to allow movement of said second key portions toward said substrate, said second key portions being in registration with a corresponding first key portion;

a rigid sheet member mounted between said first and second sheets of flexible material, said rigid sheet member having a plurality of apertures formed therein wherein each aperture is in registration with a corresponding first and second key portion of said flexible sheet;

a first flexible electrical conductor secured to one side of the first key portion of said first flexible sheet;

a second flexible electrical conductor secured to the side of said second key portion adjacent said first electrical conductor;

and circuit means connected to said first and second electrical conductors whereby depression of one of said first key portions moves said first electrical conductor into contact with the second electrical conductor of an adjacent second key portion to generate an electrical signal over said circuit means and where further depression of said first key portion results in the movement of said first and second key portions together with the engaged first and second electrical conductors to a position within said recessed portions in said support means to provide a tactile feedback with respect to said depression.

5. The keyboard apparatus of claim 4 in which said first and second key portions comprise a discrete bubble projection, the bubble projections of said second flexible sheet projecting through an aperture in said rigid sheet to a position spaced from said substrate sufficient to allow the bubble projection of said flexible sheets and their associated electrical conductors to move within the recessed portions of said substrate upon depression of the bubble projection in said first flexible sheet to increase the tactile feedback with respect to such depression.

6. The keyboard apparatus of claim 4 in which said first and second sheets of flexible material each comprise a planar sheet of plastic material, portions of which represent a key member, said rigid sheet positioning the electrical conductors in said first and second planar sheets in a spaced relationship and where the apertures in said rigid sheet are in alignment with the key portions of said first and second planar sheets whereby upon depression of a key representing portion of said first planar sheet by an operator's finger, the key representing portion of said first and second planar sheets together with their associated electrical conductors are moved together with the operator's finger to a position within the recessed portion in said substrate to provide an electrical contact between said conductors and a tactile feedback to the operator's finger.

7. The keyboard apparatus of claim 6 in which each of said recessed portions are in alignment with the key representing portion of said first and second flexible sheets and extend to a depth in said substrate whereby upon depression of a key representing portion of said first flexible sheet, the key representing portions of said first and second flexible sheets together with their associated electrical conductors move into said recessed portion a distance sufficient to increase the tactile feedback with respect to said depression.

8. A manually-operable keyboard apparatus comprising:

a non-conductive substrate having a top surface with a plurality of apertures located therein whose width define the width of a key portion;

a first sheet of flexible polyester material disposed on said substrate having a plurality of first key portions formed integral therein each in registry with one of said apertures;

a second sheet of flexible polyester material disposed on said substrate having a plurality of second key portions formed integral therein each in registry with an associated first key portion;

a rigid sheet of polyester material disposed between said first and second sheets of polyester material, said rigid sheet having a plurality of apertures formed therein wherein each aperture is in registration with a corresponding first and second key portions of said flexible polyester sheets;

a first flexible electrical conducting coating secured to one side of the first key portion of said first flexible polyester sheet;

a second flexible electrical conducting coating secured to the side of said second key portion adjacent said first electrical conducting coating;

and circuit means connected to said first and second electrical conducting coating whereby depression of one of said first key portions moves said first electrical coating into contact with the electrical coating of an adjacent second key portions to generate an electrical signal over said circuit means and where further depression of said first key portion results in the movement of said first and second key portions together with the engaged electrical conducting coatings to a position within the apertures in said support means to provide a tactile feedback with respect to said movement.

9. The keyboard apparatus of claim 8 in which said first and second key portions comprised a raised discrete bubble portion with the bubble portion of said second flexible sheet projecting through an aperture in said rigid sheet to a position spaced from said substrate sufficient to allow the bubble portions of said flexible polyester sheets and their associated conducting coating to move to a position within the apertures in said substrate upon depression of the bubble portions in said first flexible sheet to increase the tactile feedback with respect to such depression.

10. The keyboard apparatus of claim 8 in which said first and second sheets of flexible polyester material are each comprised of a planar sheet of polyester material, portions of which represent a key member, said rigid sheet positioning the electrical conducting coating of said first and second planar sheets in a spaced relationship and where the apertures in said rigid sheet are in alignment with the key portions of said first and second planar sheets of polyester plastic material whereby upon depression of a first key portion of said first planar sheet by an operator's finger, the portions of said first and second planar sheets together with their associated electrical conducting coatings are moved to a position within the apertures in said substrate to provide an electrical contact between said coatings and a tactile feedback to the operator's fingers.

11. The keyboard apparatus of claim 10 in which each of said apertures are in registry with the key portions in said first and second flexible sheets and extend to a depth in said substrate whereby upon depression of a first key portion in said first flexible sheet, the first and second key portions together with their associated electrical conducting coatings move into said apertures a distance to increase the tactile feedback of said depression.

* * * * *